US005180542A

United States Patent [19]

Brown

[11] Patent Number: 5,180,542

[45] Date of Patent: Jan. 19, 1993

[54] CONTAINER

[75] Inventor: David J. Brown, Hamworthy, United Kingdom

[73] Assignee: British Nuclear Fuels plc, Warrington, England

[21] Appl. No.: 809,342

[22] Filed: Dec. 18, 1991

[30] Foreign Application Priority Data

Nov. 2, 1991 [GB] United Kingdom ..... 9123282

[51] Int. Cl.[5] ..... G21C 19/00

[52] U.S. Cl. ..... 376/272; 250/506.1; 250/507.1

[58] Field of Search ..... 252/626, 633; 250/506.1, 507.1; 376/272; 423/DIG. 20

[56] References Cited

U.S. PATENT DOCUMENTS 4,453,857 6/1984 Sena et al. ..... 405/128
4,594,513 6/1986 Suzuki et al. ..... 250/506.1
4,701,280 10/1987 Canevall ..... 252/633
4,784,802 11/1988 Mallory et al. ..... 252/633
4,844,840 7/1989 Feizollahi ..... 252/633
4,950,426 8/1990 Markowitz et al. ..... 252/633
4,996,019 2/1991 Catalayoud et al. ..... 376/272

*Primary Examiner*—Donald P. Walsh
*Assistant Examiner*—Ngoclan T. Mai
*Attorney, Agent, or Firm*—William R. Hinds

[57] ABSTRACT

A container for material contaminated with a toxic substance or a radionuclide has a base with recesses. A highly absorbent cementitious material is disposed in the recesses for absorbing any liquid in the container. The cementitious material is made by mixing together a sodium bentonite clay slurry and a cement slurry at a water/solids ratio of about 1.5/1. Subsequent heating of the mixture removes capillary water without substantially dehydrating any hydrated cement.

13 Claims, 2 Drawing Sheets

CONTAINER

This invention relates to a container, and more particularly to a container for material contaminated with a toxic substance or with a radionuclide.

In the nuclear industry, material such as mechanical components, rubber gloves, or liquids such as oils can become contaminated with radionuclides, for example, iodine 129, uranium, radium 226, and thorium 232. It is the normal practice to place such material in suitable containers, and subsequently to store the containers in specially designed vaults or caves. In order to make more effective use of the space in the vaults or caves a high packing of the contaminated material is desirable.

According to one aspect of the present invention, in a container for material contaminated with at least one toxic material or a radionuclide, there is provided highly absorbent cementitious material for absorbing liquid in the container.

The container may be adapted to receive compacted receptacles containing the contaminated material, and the liquid may be leakage from said compacted receptacles.

Preferably, the cementitious material has a voidage of at least 40% by volume.

Desirably, the cementitious material comprises cement hydrated beyond 25% thereof.

The cementitious material may be made by a method comprising forming a cement slurry and a bentonite clay slurry, subsequently mixing together the cement slurry and the clay slurry, and heating the resulting mixture at a temperature such as to remove capillary water from the mixture without to a substantial extent dehydrating any hydrated cement.

Preferably, the temperature is at least 50° C.

Advantageously, the mixed cement slurry and clay slurry has a water/solids ratio of about 1.5/1.

The cement may comprise typical Portland cement (OPC).

The water absorption capacity of cementitious material depends inter alia on the internal porosity of the material. Hence, to produce a cementitious material having a relatively high absorption capability it is necessary to use a high water content in its preparation. Whilst the maximum water/cement ratio that can be achieved using a low shear system is about 0.45, a water/solids ratio up to about 1.5/1 can be achieved by the addition of a suitable clay, viz: bentonite clay. When such a clay/cement/water mixture is heated to drive out the capillary water without dehydrating any hydrated cement to a substantial extent, an internal porosity of up to 75% by volume may be achieved. Provided that the cement has hydrated beyond 25% thereof, the ratio of hydrated to unhydrated cement should have little influence on the absorption capacity of the dried cementitious material in the short term, on the assumption that the water in the setting cement material is evenly distributed.

BRIEF DESCRIPTION OF THE DRAWINGS

The invention will now be further described by way of example only with reference to the accompanying drawings in which:

Referring now to FIGS. 1 and 2, part of a container 10 is shown, the container 10 being rectangular in plan and comprising a base 12 and side walls 14, 16. Crossed rails 18 forming a grid structure are disposed on the base 12, and define rectangular recesses 19 in which a highly absorbent cementitious material 20 is disposed for absorbing any liquids, for example, seepage of liquid from compacted boxes 22 (shown in broken line). The compacted boxes 22 contain material and articles (not shown) contaminated with radionuclides and for subsequent storage in vaults or caves. By compacting the boxes 22, a high packing density can be achieved to make the most effective use of the space inside the vault or cave. The space between the compacted boxes 22 inside the container 10 is filled with a known cementitious grout (not shown),—see for example GB-A-2196548, and the container 10 is capped with a lid (not shown).

Figure 1:
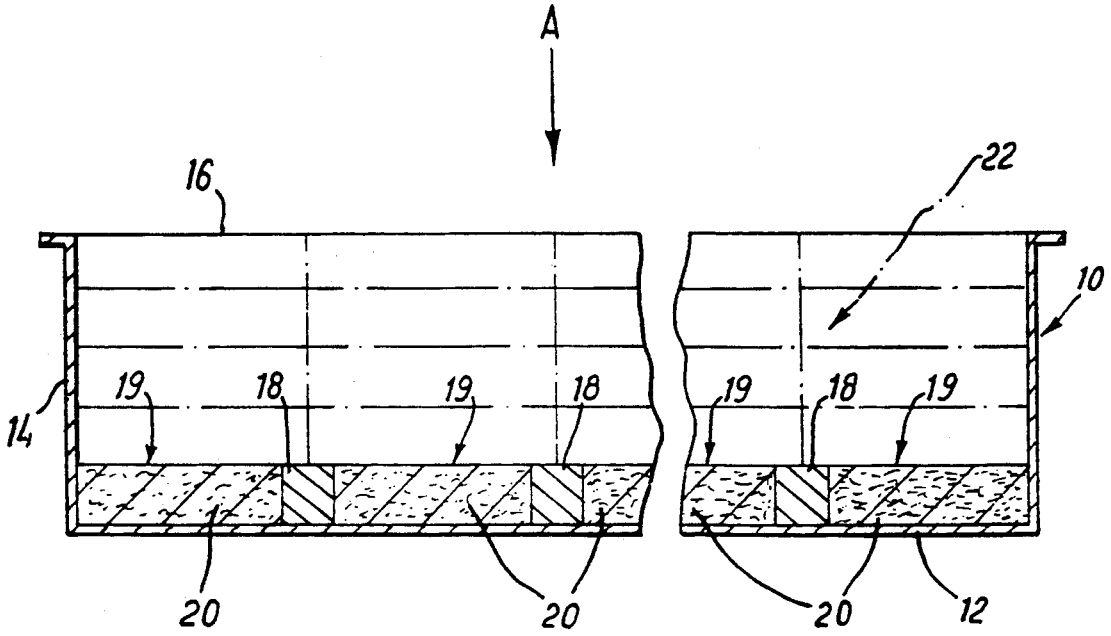
FIG. 1 shows a side sectional representation of a container for nuclear waste material.
Figure 2:
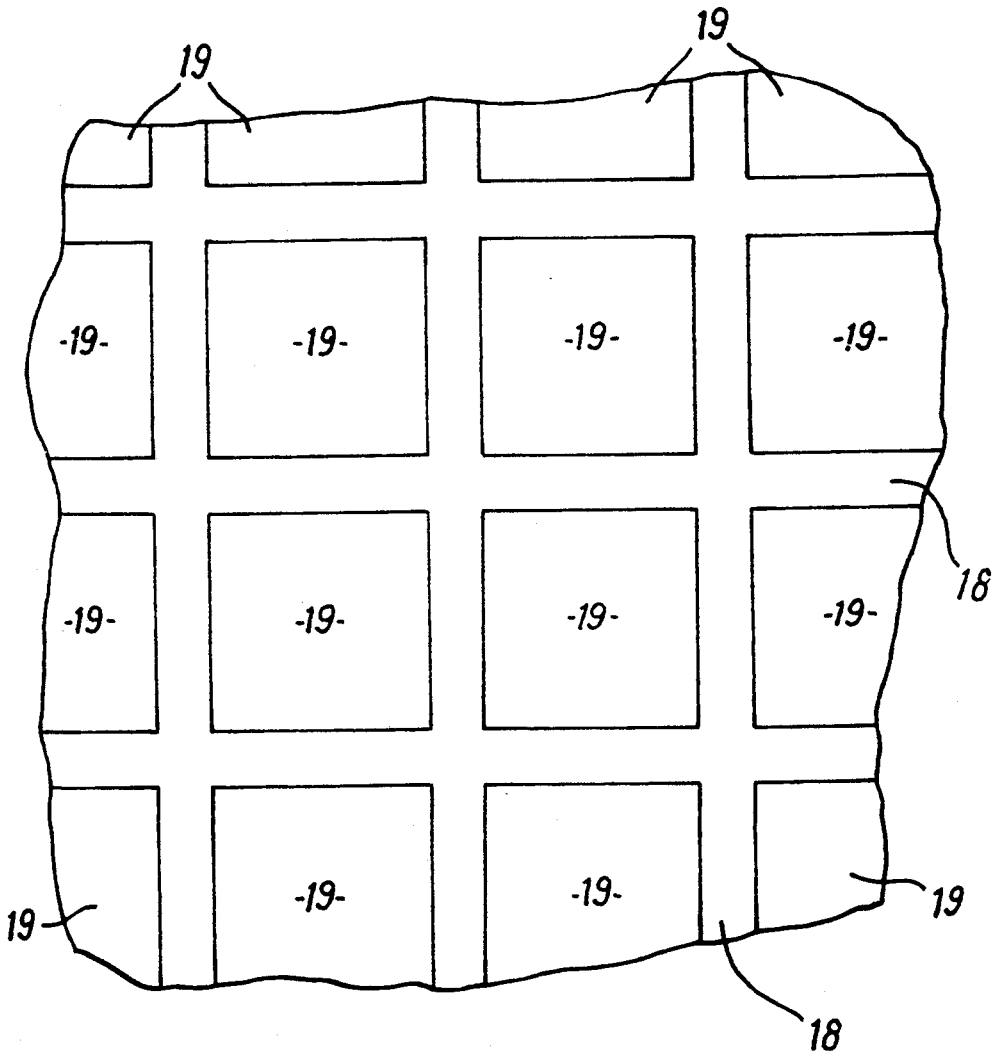
FIG. 2 shows a fragmentary view in the direction of arrow A of FIG. 1.

The cementitious material 20 comprises OPC with the addition of a clay, such as sodium bentonite, and provides a liquid absorption capability of about 75% by volume. A preferred sodium bentonite clay is sold under the Trade Marks "Volclay" and "Steebent". "Volclay" sodium bentonite clay (Civil Engineering Grade) is sold by: Volclay Limited, Wallasey, Merseyside, England. "Steebent" sodium bentonite clay (Civil Engineering Grade) is sold by Steetley Minerals Limited, Woburn Road, Woburn Sands, Milton Keynes, England.

Examples of the preparation of suitable cementitious material 20 are as follows:

EXAMPLE I

A hydrated clay slurry was prepared by adding Volclay sodium bentonite clay to water to make a 5% (by weight) solution, the hydrated clay slurry then being allowed to stand for twenty four hours.

A Portland cement slurry was prepared in batches using a water/cement ratio of about 0.45 in a low shear mixing system for about 15 minutes. The cement slurry was then mixed with the hydrated clay slurry and high sheared in a mixer for a further one hour. The amount of hydrated clay slurry was arranged so that the resulting mixture had a water/solids ratio of about 1.5/1. The mixture was poured into moulds and allowed to stand for twenty four hours at ambient temperature. The mixture was then removed from the moulds as individual blocks of 130×180×250 mm, and placed in an oven for drying at between 50° C. and 100° C. for between 5 and 6 days. After drying the blocks were allowed to cool to ambient temperature and then stored in airtight enclosures until required in the container 10. The cementitious blocks had a liquid absorption capability of about 75% by volume.

EXAMPLE II

Example I was repeated but with a hydrated clay slurry made using a 6% (by weight) solution of Steebent sodium bentonite clay. In other respects Example II was the same as Example I. The cementitious blocks had a liquid absorption capability of about 70% by volume.

As an alternative in Examples I and II, the blocks before drying may be broken into granules, for example, between 5 and 70 mm, and the granules subsequently dried in the oven. The dried granules may then be used in the recesses 19 instead of the blocks of Examples I and II.

It is considered that the high porosity of the cementitious mixtures of Examples I and II is due to a large extent to the physical characteristics of the clay.

The reference to water/cement and water/solids ratios herein refers to the volume of water (liters) and the weight of cement or solids (grammes).

I claim:

1. A container for material contaminated with a toxic substance or a radionuclide, wherein the improvement comprises, the container having a base, intersecting members at the base inside the container define a plurality of recesses therebetween, and absorbent cementitious material disposed in the recesses for absorbing liquid in the container.

2. A container as claimed in claim 1, wherein the cementitious material has a voidage between 40% and 75% by volume.

3. A container as claimed in claim 2, wherein the cementitious material comprises cement hydrated beyond 25%.

4. A container as claimed in claim 3, wherein the cementitious material comprises blocks disposed in respective recesses.

5. A container as claimed in claim 3, wherein the cementitious material comprises granules, the granules being between 5 mm and 70 mm.

6. A container as claimed in claim 1, the container being filled with compacted receptacles containing the contaminated material such that the liquid comprises any leakage from said compacted receptacles, and space in the container between the compacted receptacles being filled with a cementitious grout.

7. A container as claimed in claim 1, wherein the cementitious material is made by forming a cement slurry and a sodium bentonite clay slurry, subsequently mixing together the cement slurry and the clay slurry, and heating the resultant mixture at a temperature such as to remove capillary water from the mixture without to a substantial extend dehydrating any hydrated cement.

8. A container as claimed in claim 7, wherein the temperature is between 50° C. and 100° C.

9. A container as claimed in claim 8, wherein the mixed cement slurry and the clay slurry has a water/-solids ratio of about 1.5/1.

10. A container as claimed in claim 9, wherein the clay slurry comprises about 5% (by weight) solution.

11. A container as claimed in claim 10, wherein the resultant mixture is poured into moulds before said heating to form rectangular blocks thereof to fit the recesses.

12. A container as claimed in claim 11, wherein the blocks are broken into granules before said heating, the granules being between 5 mm and 70 mm.

13. A container as claimed in claim 7, wherein the heating is followed by cooling of the resultant mixture and subsequent storage, until required in a said container, in an airtight environment.

* * * * *